US006036044A

United States Patent [19]

Parker et al.

[11] Patent Number: 6,036,044

[45] Date of Patent: Mar. 14, 2000

[54] MODULAR DIVIDED CONTAINER

[76] Inventors: Elaine Parker; Gary Parker, both of 128 Summa St., West Palm Beach, Fla. 33405

[21] Appl. No.: 09/237,849

[22] Filed: Jan. 27, 1999

[51] Int. Cl.[7] ..... B65D 25/06

[52] U.S. Cl. ..... 220/507; 206/745

[58] Field of Search ..... 206/736, 745, 206/756, 775, 784, 45.25; 220/507, 503, 62, 6, 4.08, 4.28, 23.8, 529, 553, 557, 653; 229/109

[56] References Cited

U.S. PATENT DOCUMENTS

| | | | |
|---|---|---|---|
| 377,857 | 2/1888 | King | 220/503 |
| 1,924,823 | 8/1933 | Willi . | |
| 2,291,265 | 7/1942 | Viglietta . | |
| 3,812,957 | 5/1974 | Forbes, Jr. . | |
| 4,192,439 | 3/1980 | Segal | 222/130 |
| 4,366,641 | 1/1983 | Price et al. | 43/54.1 |
| 5,207,321 | 5/1993 | Jones | 206/223 |
| 5,642,830 | 7/1997 | Foster | 220/4.28 |
| 5,865,316 | 2/1999 | Smith | 206/775 |

*Primary Examiner*—Stephen Castellano
*Attorney, Agent, or Firm*—McHale & Slavin

[57] ABSTRACT

A modular, multi-compartment container includes four pre-stamped blanks of material, such as paperboard that may be folded into a preferred orientation and placed into a cooperative arrangement. The blanks of material form a contiguous ring of outwardly-facing compartments and a selectively covered internal chamber. Vertically-aligned pairs of apertures accommodate included hollow tubes. The tubes increase the structural integrity of the container and may be used for storage and display purposes as well. A corrugated base is also included.

7 Claims, 8 Drawing Sheets

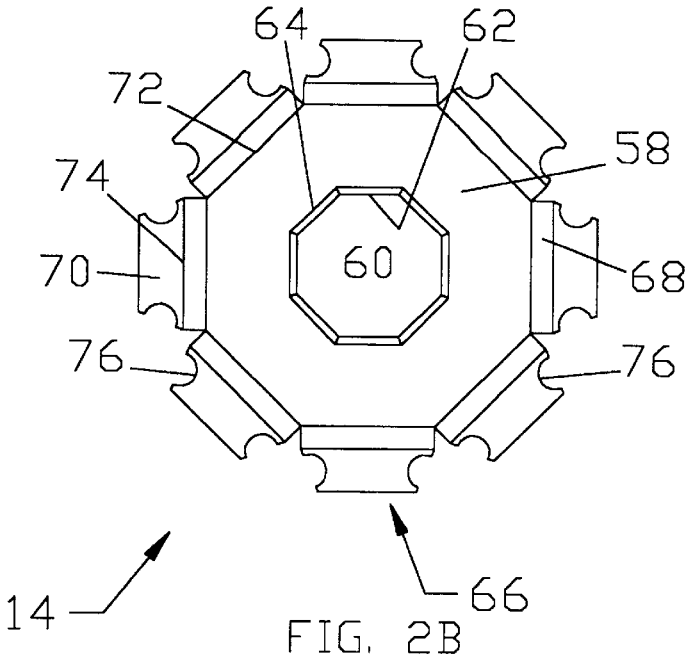
FIG. 2B
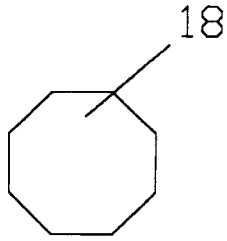
FIG. 2D
FIG. 2C
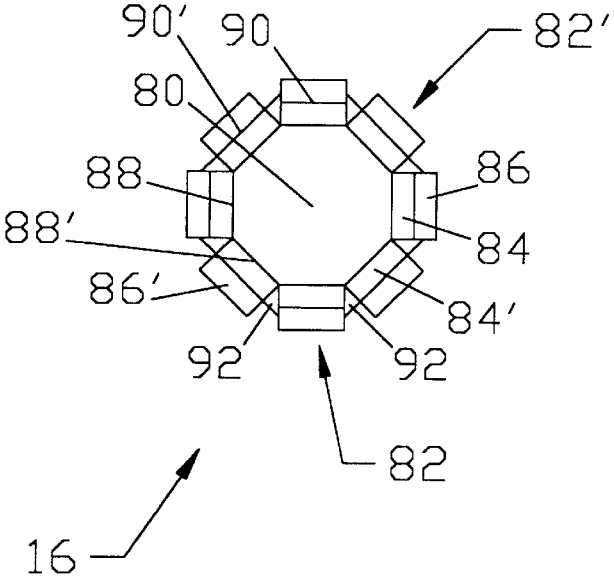
FIG. 2E
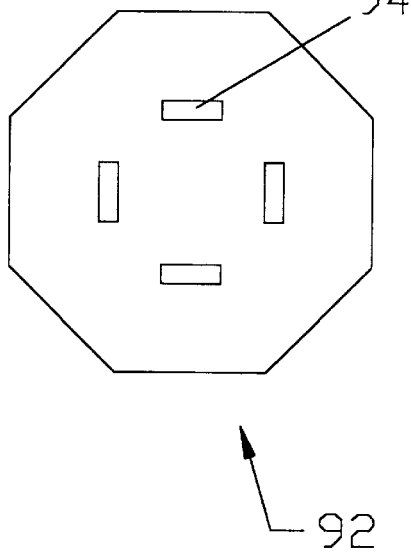

MODULAR DIVIDED CONTAINER

FIELD OF THE INVENTION

This invention is directed to storage and display containers and, in particular, to a multi-piece container formed largely of paperboard or similar material.

BACKGROUND OF THE INVENTION

The use of boxes as storage devices is well known, and boxes are used to ship a wide variety of items. Boxes may be used in commerce to transport freight from one location to another, and in the moving industry to protect goods as they travel from one location to another. Boxes are not only used for storage purposes during transit, they are also often used to display items upon arrival at their final destinations. As a result, a variety of box and carton designs exist, with each design addressing certain needs.

Some boxes are designed to safely transport unique cargo. For example, U.S. Pat. No. 4,717,022 discloses a carton having interior support panels that engage an electric light bulb. This carton not only provides an external cover for the bulb, it also maintains the bulb in a preferred orientation within the carton. Another example of a container designed to hold unique cargo is shown in U.S. Pat. No. 4,936,046, which shows a receptacle for the transport, storage and display of plants. The '046 container includes a hydrophillic liner that retains moisture and humidity as the plant is transported.

Other containers are designed specifically to display contents. One example of a container that is especially suited for use as a display device is shown in U.S. Pat. No. 2,291,265. The '265 device provides a foldable container having upper and lower sections, with divided compartments in each section. This device includes overlapping portions that may be adhesively secured to one another, thereby maintaining the shape of the device even when empty. As a result, items may be placed into, and removed from, the above '265 device as needed.

Some cartons are designed for the dual purposes of protecting cargo during shipping and displaying cargo upon arrival. For example, U.S. Pat. No. 3,812,957 discloses a divided carton that includes both an enclosed region and an exposed region. Cutouts are included to secure items within the exposed region. With this arrangement, the '957 carton simultaneously provides two sections that may be protected during transit, with one of the sections serving as a display region when the carton reaches its final destination.

U.S. Pat. No. 5,007,530 also may be used to transport and display goods. The '530 device includes an interior storage region and a hinged lid. When the '530 device is closed, the interior chamber, and the contents therein, are protected. However, the hinged lid has an angled shape that places the interior chamber at a display-facilitating incline when the '530 device is open.

Other containers are useful not only for shipping and displaying cargo, they are also useful for dispensing the items they contain. For example, U.S. Pat. No. 1,924,823 discloses a compartmented carton with see-through outer walls and a cooperating pair of rotating disks that serve as a lid. Each of the disks includes an aperture, and aligning the apertures allows access to the contents inside the '823 carton.

A variety of boxes and containers exists. Many excel in certain areas, while falling short in others. For example, although some boxes provide excellent protection during shipment, they are not useful for displaying the items contained therein. These boxes require transfer of cargo to a designated display device upon arrival. Other devices are useful for display purposes, but are too flimsy to provide protection during shipment. Still other devices may sufficiently protect items during shipment and subsequently allow display of the goods contained therein. Unfortunately access to the items displayed by these containers is only possible by dismantling the container. Still other containers are shipment-and-display-worthy, and even provide convenient access to the items contained therein. These devices, however, are typically assembled with adhesives and may not be easily assembled by an end user who wishes to ship and display goods of his own.

Thus, what is needed is a modular, divided container that includes the advantages of the known devices while addressing the shortcomings they exhibit. The container should be easy to assemble without the need for tools or adhesives. The device should also protect items placed therein and provide a variety of separate compartments to hold different types of items. The container should also allow removal of items placed therein without reducing the structural integrity of the container. The device should also be formed from components that may be shipped flat and assembled just prior to use, at any location desired. The device should include an interior chamber that may be selectively covered, thereby providing a region with heightened concealment and security properties. The device should also include interchangeable components that may be selected and changed according to desired appearance without requiring the removal of contents or dismantling of the device.

SUMMARY OF THE INVENTION

The instant invention is a modular, divided container useful for shipping, storing, displaying, and dispensing a variety of items. The container employs several pre-stamped blanks of material, such as paperboard that may be folded into a preferred orientation and placed into a cooperative arrangement. When the blanks have been arranged in the preferred orientation, the device provides a ring of adjacent, outwardly-facing compartments and a selectively concealed interior chamber. A series of hollow tubes is also used to provide additional storage regions, while increasing the structural integrity of the container.

The first blank of material includes a central floor panel having a collection of arm panels extending radially therefrom. Each arm is folded about the floor panel and through a central aperture disposed within the floor panel to provide boundary panels that cooperatively produce the compartments of the present device. Each arm panel is divided into pre-determined regions by score lines to facilitate the folding of the arm panels. The floor panel and a section of each arm panel includes a tube-accepting aperture. These apertures are disposed in vertically aligned pairs, thereby allowing vertical engagement of included tubes.

The second blank of material includes a roof panel characterized by a central aperture. Additionally, a series of positioning flaps is hingedly attached to the perimeter of the roof panel. Each positioning flap includes a tube-engaging arc. When the second blank of material has been folded appropriately and placed upon the top of the previously-folded first blank of material, arcs from adjacent positioning flaps cooperate to accommodate one of the above-mentioned tubes and will orient partitions to form outwardly-facing compartments. The central aperture of the roof panel is aligned with an interior chamber formed by the folded arm panels.

The third blank of material forms a cap useful for selectively covering the interior chamber produced by the arm panels of the first blank of material. The cap is inserted into the central aperture of the second blank of material.

A fourth blank of material removably rests upon tabs that extend radially into the bottom of the interior chamber. In this manner, the fourth blank of material provides a support surface that allows items to be stored inside the interior chamber. The fourth blank also covers, and prevents disengagement of, included support tabs.

Because of the interlocking nature of the elements of the present invention, the container produced is self supporting. In other words, no adhesives are need to maintain the shape of the container. Additionally, the inclusion of vertically-aligned rigid tubes advantageously allows the container to be shipped merely by enclosing the container in shrink-wrap material.

Thus, it is an objective of the instant invention to provide a modular, divided container that is easy to assemble without the need for tools or adhesives.

An additional objective of the instant invention is to provide a modular, divided container that protects items placed therein and provides a variety of separate compartments to hold different types of items.

A further objective of the instant invention is to provide a modular, divided container that allows removal of items placed therein, without reducing the structural integrity of the container.

Yet another objective of the instant invention is to provide a modular, divided container formed from components that may be shipped flat and assembled just prior to use at any location desired.

A still additional objective of the instant invention is to provide a modular, divided container with a removably-covered interior chamber, thereby selectively providing a region with heightened concealment and security properties.

Yet a further objective of the instant invention is to provide a modular, divided container that includes interchangeable components which may be selected and changed according to desired appearance, without requiring the removal of contents or dismantling of the device.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWING

FIG. 2B is a plan view of the second blank of material used in the container shown in FIG. 1;

FIG. 2C is a plan view of the third blank of material used in the container shown in FIG. 1;

FIG. 2D is a plan view of the blocking panel used in the container shown in FIG. 1;

FIG. 2E is a plan view of the corrugated base used in the container shown in FIG. 1;

DETAILED DESCRIPTION OF THE PREFERRED EMBODIMENT

Figure 1A:
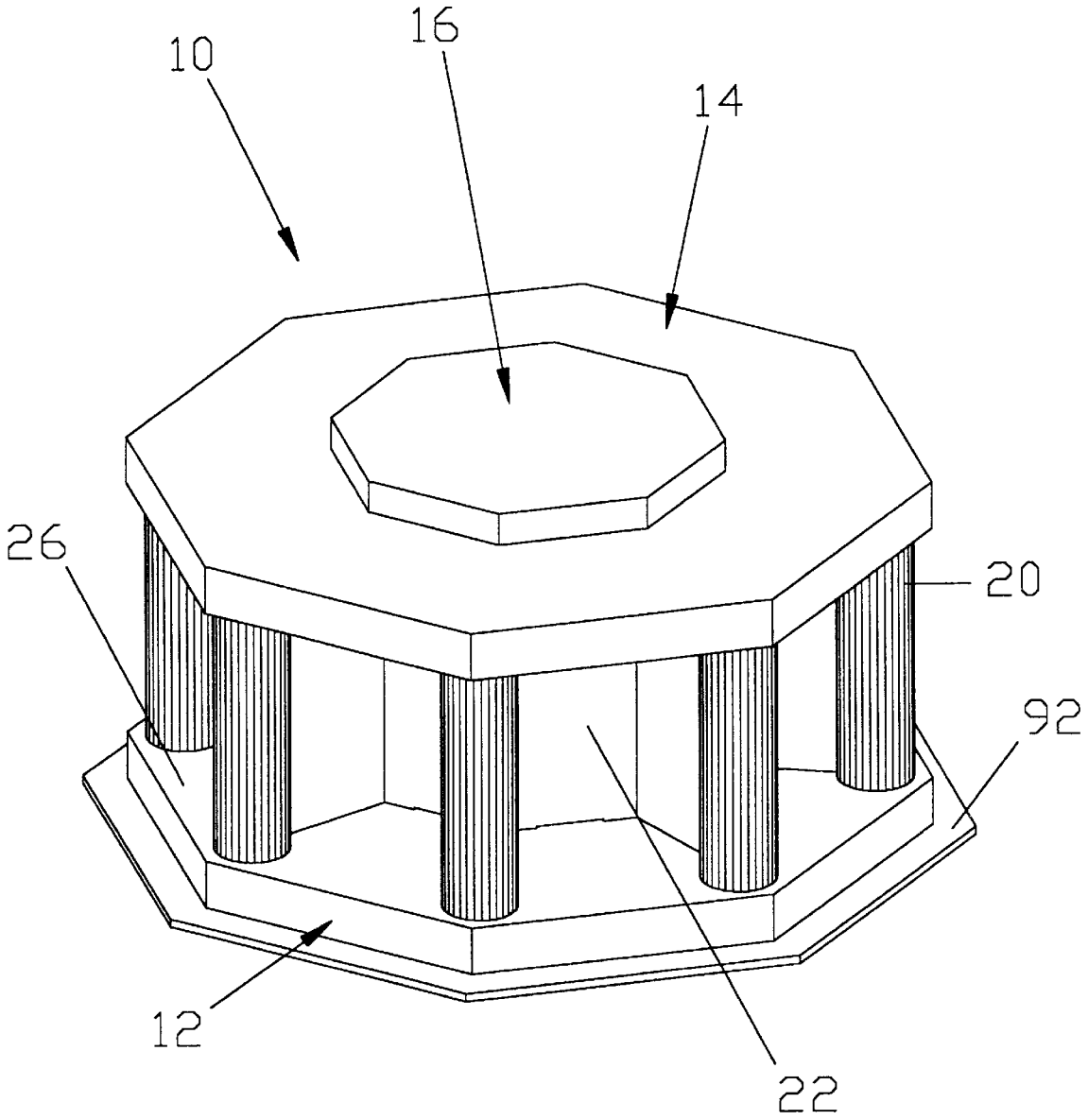
FIG. 1A is a pictorial view of the modular, multi-compartment container according to the present invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 1B:
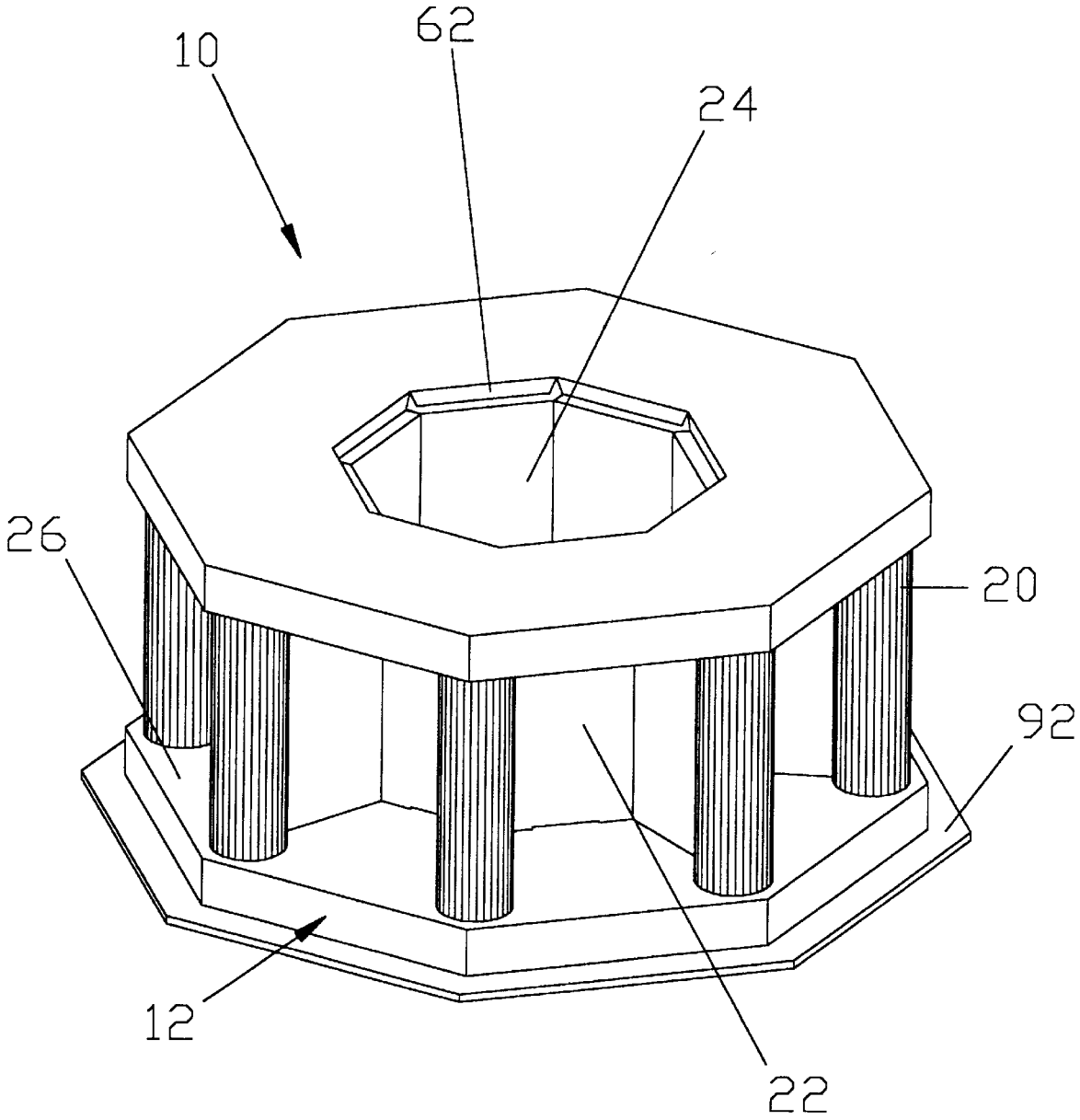
FIG. 1B is a pictorial view container shown in FIG. 1, with the cap assembly removed.

Now with respect to FIGS. 1A and 1B, the storage and display container 10 of the present device is shown. By way of overview, the container 10 is formed through a cooperative arrangement of several paper blanks 12, 14, 16, a removable blocking panel 18, and a collection of rigid locking tubes 20. As will be described more fully below, the display container 10 is characterized by a contiguous series of outwardly-facing compartments 22 that surround an essentially-hollow interior chamber 24. The above-mentioned blocking panel 18 is disposed within the interior chamber 24, and selectively provides a support surface therein. Additionally, the above mentioned third blank of material 16 may be folded to removably cover the interior chamber 24. The above mentioned locking tubes 20 help maintain the relative position of folded portions of the blanks of materials 12, 14, while also advantageously increasing the structural integrity of the container 10. The details of the container 10 will now be described.

Figure 2A:
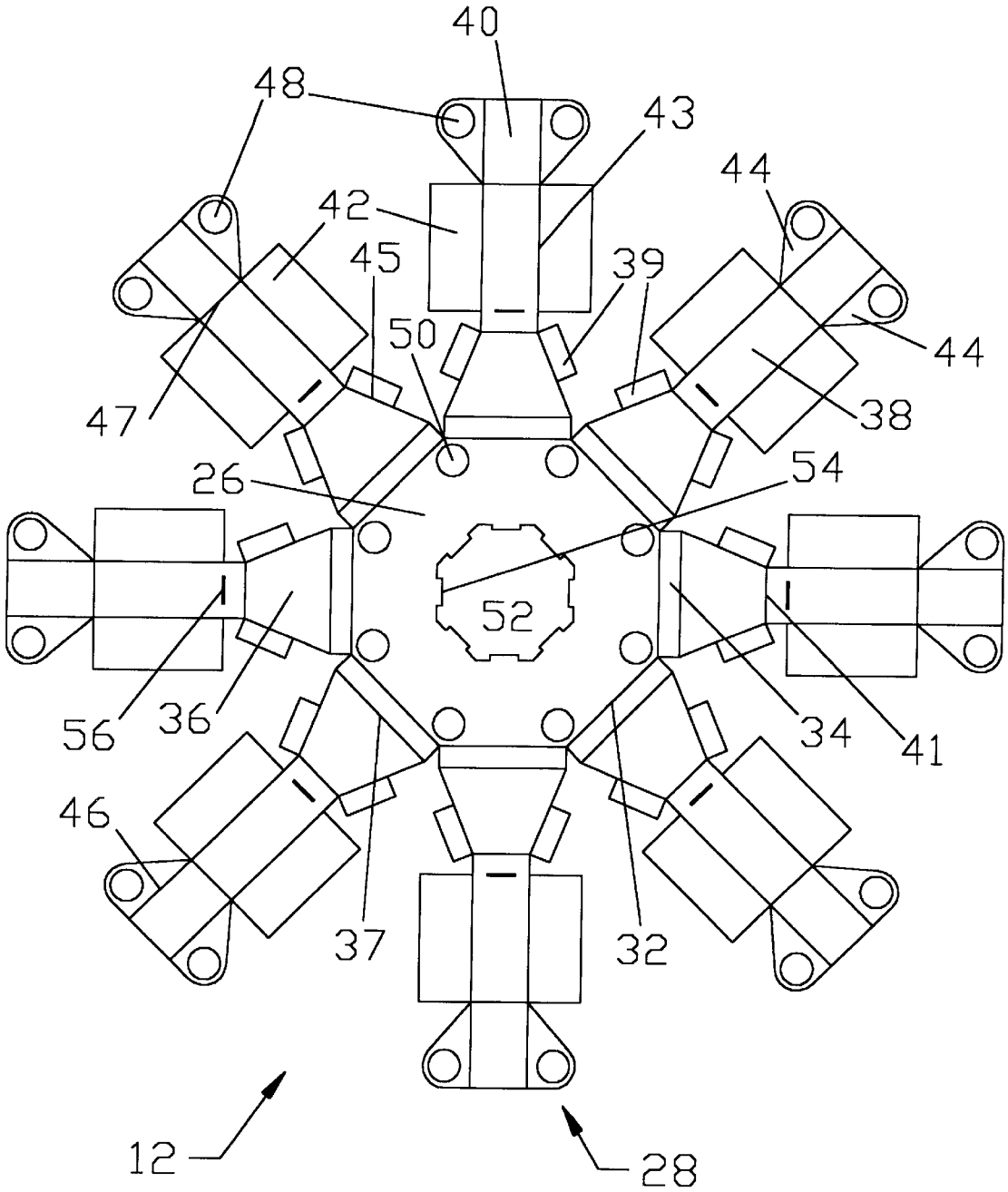
FIG. 2A is a plan view of the first blank of material used in the container shown in FIG. 1.

As seen in FIG. 2A, the first blank of material 12 is comprised of an octagonal floor panel 26 and a series of arm panels 28 that extends radially from the floor panel perimeter. Preferably, the first blank 12 is a single sheet of paperboard, or similar material, and the arm panels 28 are divided from the floor panel 26 by fold lines, described below. With continued reference to FIG. 2, each arm panel 28 has four main regions, as follows: a proximal section 34, a first middle section 36, a second middle section 38, and a distal section 40. The proximal section 34 of each arm panel 28 is hingedly attached to the floor panel 26 along a proximal section fold line 32. In turn, each proximal section 34 and first middle section 36 are hingedly joined along a first middle section fold line 37; each first middle section and corresponding second middle section 38 are hingedly connected along a second middle section fold line 41; and each second middle section and corresponding distal section 40 are hingedly joined along a distal section fold line 47.

Of additional note are base support tabs 39 and partition flaps 42 associated with each first middle section 36 and each second middle section 38, respectively. A pair of base support tabs 39 is hingedly joined to each first middle section 36, suitable for supporting the octagonal floor panel 26. The base support tabs cooperatively hold the octagonal floor above the first middle sections 36, after the middle sections are folded as described below. The partition flaps 42 are divided from the second middle sections 38 by partition flap fold lines 43. Similarly, each distal section 40 includes a pair of opposed engagement flaps 44 divided from the distal section by engagement flap fold lines 46. Each engagement flap 44 includes an upper engagement aperture 48. As will be discussed more completely below, each engagement aperture 48 corresponds with a lower engagement aperture 50. Together, pairs of engagement apertures 48, 50 cooperate to hold the rigid locking tubes 20 in place. The locking tubes 20 are preferably hollow and transparent. Although solid tubes 20 would suffice, using hollow tubes allows items to be placed within the tubes. A preferred material for the tubes 20 is plastic, although other materials, including glass, paper, or other similarly-rigid materials, may also be used.

To make the outwardly-facing compartments 22 shown in FIG. 1A, the arm panels 28 are cooperatively folded in a strategic manner. Each arm panel 283 is advantageously arranged to create a single outwardly-facing compartment 22, and the procedure for creating one outwardly-facing compartment 22 will now be described.

Figure 4A:
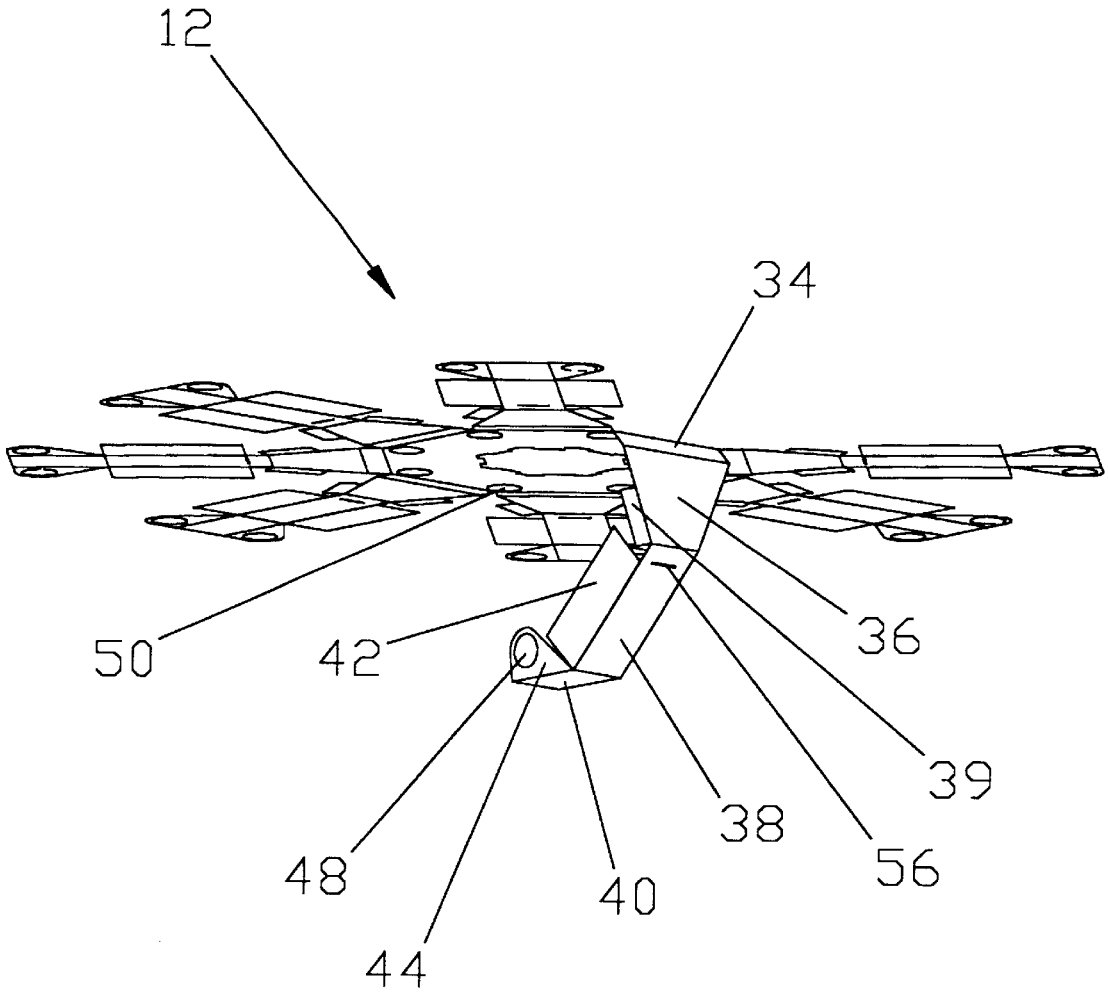
FIG. 4A is an isometric view of a partially-folded arm panel of the container shown in FIG. 1.
Figure 4B:
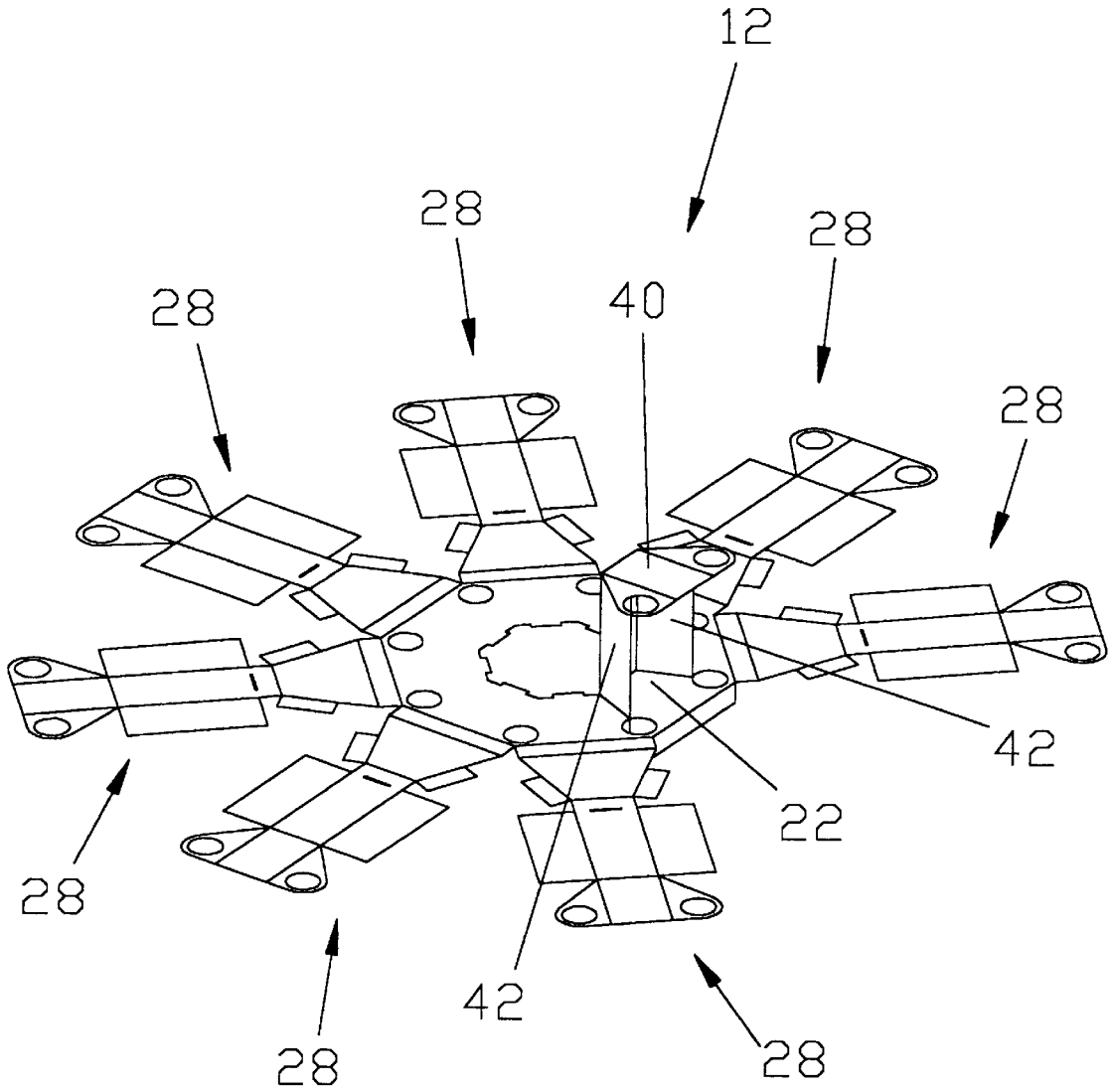
FIG. 4B is an isometric view of a fully-folded arm panel of the container shown in FIG. 1.

With reference to FIGS. 4A and 4B, an arm panel proximal section 34 is folded downward with respect to the floor panel 26 along the associated fold line 32, so that the proximal section becomes perpendicularly aligned with respect to the floor panel. Once the proximal section 34 is folded into the preferred orientation, the associated first middle section 36 is folded, along the associated first middle section fold line 37, into a perpendicular arrangement with the proximal section. More specifically, the first middle section 36 is folded into a substantially parallel relationship with the floor panel 26, with the remainder of the arm panel 28 being directed underneath the arm panel passthrough aperture 52 that characterizes the center of the octagonal floor panel 26.

Once the first middle section 36 has been oriented underneath, and parallel to, the floor panel 26, the second middle section 38 is folded upwards, along the second middle section fold line 41, until it is substantially perpendicular with the first middle section and the floor panel. As seen in FIG. 4B, when the second middle section 38 is in the preferred orientation, the associated partition flaps 42 are substantially vertical and rest upon the floor panel 26. The base support tabs 39 are also folded upward to maintain the first middle section 36 in a spaced apart relationship with the floor panel 26.

Once the second middle section 38 is in place, the distal section 40 is folded, along the distal section fold line 47, until the distal section is substantially parallel with the floor panel 26. At this point, an outwardly-facing compartment 22 has been formed. The compartment 22 is bounded by a floor panel 26, a second middle section 38, a pair of partition flaps 42, and a distal section 40. This procedure is repeated in similar fashion for each of the eight arm panels 28. Although one method of folding is presented above, other folding procedures would also suffice. For example, pairs of base support tabs 39, partition flaps 42, and engagement flaps 44 could be folded before the proximal, middle, and distal portions 34,36,38,40 are folded. The arms 28 could then be folded along fold lines 32,37,41,47 and then passed through the passthrough aperture 52 into the orientation described above.

Figure 3:
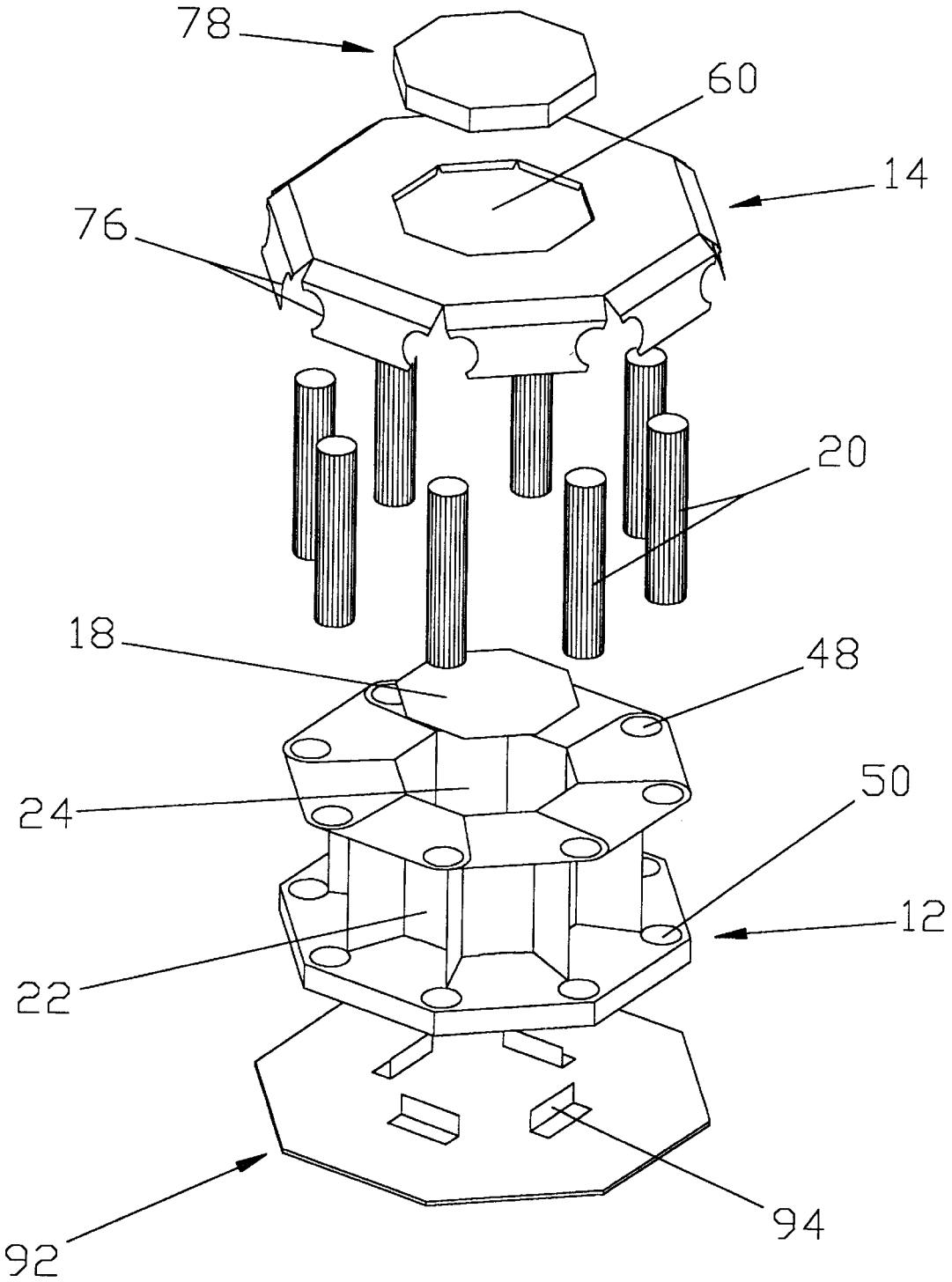
FIG. 3 is an exploded view of container shown in FIG. 1.

After the outwardly-facing compartments 22 have been formed, the locking tubes 20 are put into place. As seen in FIG. 3, one locking tube 20 is placed through each lower engagement aperture 50, with each tube resting upon an associated first middle section 36 that has been folded beneath, and parallel to, the floor panel 26. The lower engagement apertures 50 are positioned to be vertically aligned with corresponding upper engagement apertures 48. As a result, when each of the locking tubes 20 is in place, the engagement flaps 44 of each distal section 40 engages a corresponding locking tube. In this manner, each arm panel 28 is secured into a compartment-forming orientation. With this arrangement, the partition flaps 42 of each compartment 22 are maintained in a preferred angular relationship by contact with the partition flaps of adjacent compartments, and the distal sections 40 are held in place via engagement with corresponding locking tubes 20.

Figure 5:
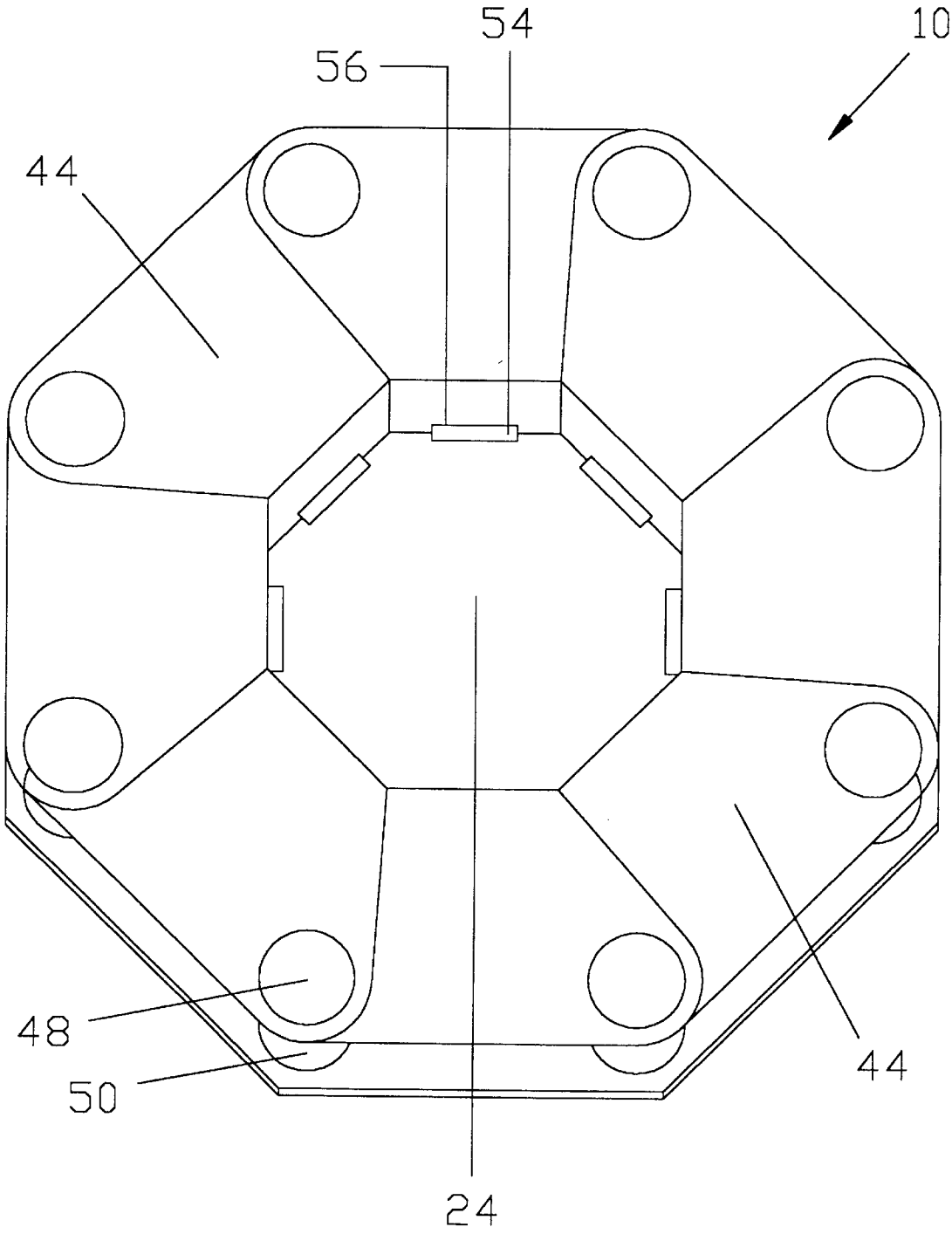
FIG. 5 is an isometric view of the interior chamber of the container shown in FIG. 1.

Now with reference to FIG. 5, the interior chamber 24 of the container 10 is shown. The interior chamber 24 is cooperatively formed by the second middle sections 38 of the arm panels 28. Passage through the bottom of the interior chamber 24 may be stopped by a removable blocking panel 18, shown in FIG. 2D. The blocking panel 18 selectively rests upon support tabs 54 that extend through tab slots 56 located within each second middle section 38. The blocking panel 18 provides a removable floor for the interior chamber 24 and allows items to be stored therein. The blocking panel 18 also increases the structural integrity of the device 10 by preventing unwanted disengagement of support tabs 54 from corresponding tab slots 56.

With reference to FIGS. 2B and 3, the second blank of material 14 is folded into a roof assembly that rests upon the distal sections 40 and locking tubes 20. When folded into a roof assembly, the second blank of material 14 helps maintain the shape of the outwardly-facing compartment 22 and prevents unwanted removal of the locking tubes.

The second blank of material 14 is preferably a single sheet of stamped paperboard, or similar material, that has been divided into several sections. The majority of the second blank forms an octagonal roof panel 58 characterized by a central roof panel aperture 60. A collection of step down flaps 62 extend from the perimeter of the roof panel aperture 60, with each step down flap being hingedly attached to the roof panel 58 along a step down flap fold line 64. The step down flaps 62 are preferably oriented substantially-perpendicular to the roof panel 58. With continued reference to FIG. 2B, the outer perimeter of the roof panel 58 is characterized by a series of positioning flaps 66. Each positioning flap 66 includes an upper portion 68 and a lower portion 70. The upper portion 68 is hingedly attached to the roof panel along an upper portion fold line 72, and the lower portion 70 is hingedly attached to the upper portion 68 along a lower portion fold line 74. Each lower portion 70 includes a pair of tube-engaging arcs 76 located on opposite and side edges thereof.

In use, the upper portion of each positioning flap is folded downward, along the corresponding upper portion fold line 72, into a substantially-perpendicular orientation with respect to the roof panel 58. Additionally, each positioning flap lower portion 70 is folded underneath the roof panel 58 and into a substantially perpendicular relationship with the corresponding upper portion 68. With the positioning flaps folded in this manner, tube-engaging arcs 76 from adjacent positioning flaps are cooperatively arranged to fit around one of the locking tubes 20. More specifically, cooperating pairs of tube engaging arcs 76 are shaped so that each cooperating pair of arcs will surround one of the vertical locking tubes 20 previously inserted into a pair of corresponding upper and lower engagement apertures 48, 50.

With reference to FIGS. 3 as the second blank of material 14 is put into place on the top of the horizontally-arranged distal sections 40, the roof panel aperture 60 is substantially-aligned with the interior chamber 24 of the container 10. As seen with reference to FIG. 1B, the diameter of the roof panel aperture 60 is slightly larger than the diameter of the interior chamber 24. As a result, each step down flap 62 rests upon a portion of one arm panel distal section 40, thereby maintaining the roof panel 58 in a spaced apart relationship with the arm panel distal sections 40.

Now with reference to FIG. 2C, the third blank of material 16 is shown in detail. The third blank of material 16 is folded into a cap assembly 78 sized to selectively cover the interior chamber 24 of the container 10 of the present invention. The third blank of material 16 includes a single sheet of stamped paperboard, or similar material, that is divided into several sections. More specifically, the third blank of material 16 includes a central cap panel 80 and two types of flaps 82, 82' extending radially therefrom. Each type of flap 82, 82' includes a proximal portion 84, 84' and a distal portion 86, 86'. Each flap proximal portion 84, 84' is hingedly attached to the cap panel 80 along a flap attachment line 88, 88'. Each distal portion 86, 86' is attached to the flap proximal portion 84, 84' along a flap fold line 90, 90'. The proximal and distal portions 84, 86 of the first type of flap 82 are essentially rectangular. However, only the distal portion 86' of the second type of flap 82' is rectangular; the proximal portion 84' is trapezoidal.

In use, each proximal portion 84, 84' of the cap assembly flaps 82, 82' is folded downward, along corresponding flap attachment lines 88, 88', into a substantially-perpendicular arrangement with the cap panel 80. Once each proximal portion 84, 84' has been folded appropriately, each distal portion 86, 86' is folded upwards, against the corresponding proximal portion 84, 84'. As seen with continued reference to FIG. 2C, the trapezoidally-shaped proximal portions 84' of the second type of flap 82' provide securing tabs 92 that are inserted between folded proximal and distal portions 84, 86 of the first type of flaps. With this arrangement, adjacent flaps 82, 82' are frictionally secured to one another.

Once folded into this preferred orientation, the cap assembly may be selectively used to cover the interior chamber 24 of the container 10. As seen with reference to FIG. 1A and 3, the cap assembly is partially inserted through the roof panel aperture 60, with the flap fold line 90, 90' of each flap 82, 82' resting upon a corresponding distal section 40 of one arm panel 28. Because the diameter of the roof panel aperture 60 is slightly larger than the diameter of the interior chamber 24, the cap assembly remains frictionally secured in place, until removal is desired.

The assembled container 10 may be placed on a corrugated base 92 for additional support; the base may also be decorated, to change the overall appearance of the device 10. As shown in FIG. 2E, the base 92 includes base alignment tabs 94 that fold upward and engage the lowermost portion of the interior chamber 24. The alignment tabs 94 are sized to clear the support tabs 54, allowing use of the blocking panel 18, as needed. The base 92 may be cardboard or other sufficiently-rigid material.

With this arrangement, the interior chamber 24 may include a hidden gift, not shown, or the cap assembly 78 may serve as a support base for an item, not shown, placed onto the cap panel 80. Additionally, each outwardly-facing compartment 22 may hold items, with the floor panel 26 serving as a support surface therefor. Moreover, each of the locking tubes is preferably hollow and, accordingly, may be filled with decorative items.

Although the preferred embodiment of this container 10 is octagonal, other shapes may be formed as desired. Additionally, although the container 10 is preferably made of paperboard, other suitable materials may be used. In keeping with the objectives of the present invention, the present container 10 may be assembled without the use of adhesives. However, fastening materials, including tape, glue, staples, and the like, may be used to provide redundant securement. The assembled container may be shrink-wrapped and used as a shipping container, without the need for additional outer containers.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A multi-compartmented storage and display container formed from paperboard or the like, comprising:

a first blank of material including a plurality of radially-aligned arm panels extending from a floor panel; each of said arm panels having a proximal section spaced apart from a distal section by a first middle section and a second middle section, each of said proximal sections being hingedly attached to said floor panel; said floor panel including an arm panel passthrough aperture sized and positioned to accept passage therethrough of said second middle sections and said distal sections; said floor panel including a plurality of lower engagement apertures; each of said second middle sections including at least one partition flap extending therefrom; each of said distal sections including at least one engagement flap extending therefrom, said engagement flap including an upper engagement aperture passing therethrough; and a plurality of locking rods, each locking rod extending between one of said lower engagement apertures and a corresponding one of said upper engagement apertures, each locking rod having a length at least as long as the length of said second middle sections;

whereby each of said arm panels is adapted to be folded so that said distal section is substantially perpendicular to said floor panel, with each said first middle section simultaneously being substantially parallel to said floor panel, with each said second middle section extending through said arm panel passthrough aperture and being substantially perpendicular to said floor panel, and each said distal section being substantially parallel to said floor panel; thereby forming an interior chamber bounded by said second middle sections, and a contiguous series of outwardly-facing divided compartments each bounded by said floor panel, at least one of said partition flaps, and one of said distal sections; and whereby each of said locking rods extends between one of said lower engagement apertures and a corresponding one of said upper engagement apertures.

2. The multi-compartmented storage and display container of claim 1, further including a blocking panel adapted to selectively span said passthrough aperture.

3. The multi-compartmented storage and display container of claim 2, further including a second blank of material having a roof panel with a plurality of positioning flaps extending radially therefrom, said roof panel being perforated by a roof panel aperture; each of said positioning flaps including a proximal portion hingedly attached to said roof panel, and a distal portion attached to said proximal portion; each of said proximal and distal portions being adapted to engage at least one of said locking rods inserted therethrough, when each of said distal portions are folded into a substantially parallel arrangement with said roof panel.

4. The multi-compartmented storage and display container of claim 3, further including a third blank of material including a cap panel having a plurality of spacing flaps extending radially therefrom, said cap panel being sized to substantially span said roof panel aperture.

5. The multi-compartmented storage and display container of claim 1, further including a second blank of material having a roof panel with a plurality of positioning flaps extending radially therefrom, said roof panel being perforated by a roof panel aperture; each of said positioning flaps including a proximal portion hingedly attached to said roof panel, and a distal portion attached to said proximal portion; each of said proximal and distal portions being adapted to engage at least one of said locking rods inserted therethrough, when each of said distal portions are folded into a substantially parallel arrangement with said roof panel.

6. The multi-compartmented storage and display container of claim 5, further including a third blank of material including a cap panel having a plurality of spacing flaps extending radially therefrom, said cap panel being sized to substantially span said roof panel aperture.

7. A multi-compartmented storage and display container formed from paperboard or the like, comprising:

a first blank of material including a plurality of radially-aligned arm panels extending from a floor panel; each of said arm panels having a proximal section spaced apart from a distal section by a first middle section and a second middle section, each of said proximal sections being hingedly attached to said floor panel; said floor panel including an arm panel passthrough aperture sized and positioned to accept passage therethrough of said second middle sections and said distal sections; said floor panel including a plurality of lower engagement apertures; each of said second middle sections including at least one partition flap extending therefrom; each of said distal sections including at least one engagement flap extending therefrom, said engagement flap including an upper engagement aperture passing therethrough;

a plurality of locking rods, each locking rod extending between one of said lower engagement apertures and a corresponding one of said upper engagement apertures, each locking rod having a length at least as long as the length of said second middle sections;

a blocking panel adapted to selectively span said passthrough aperture;

a plurality of support tabs extending radially inward an interior surface of said interior chamber, said tabs adapted to support said blocking panel;

a second blank of material having a roof panel with a plurality of positioning flaps extending radially therefrom, said roof panel being perforated by a roof panel aperture; each of said positioning flaps including a proximal portion hingedly attached to said roof panel, and a distal portion attached to said proximal portion; each of said proximal and distal portions being adapted to engage at least one of said locking rods inserted therethrough, when each of said distal portions are folded into a substantially parallel arrangement with said roof panel;

a third blank of material including a cap panel having a plurality of spacing flaps extending radially therefrom, said cap panel being sized to substantially span said roof panel aperture;

whereby each of said arm panels is adapted to be folded so that said distal section is substantially perpendicular to said floor panel, with each said first middle section simultaneously being substantially parallel to said floor panel, with each said second middle section extending through said arm panel passthrough aperture and being substantially perpendicular to said floor panel, and each said distal section being substantially parallel to said floor panel; thereby forming an interior chamber bounded by said second middle sections, and a contiguous series of outwardly-facing divided compartments each bounded by said floor panel, at least one of said partition flaps, and one of said distal sections; and whereby each of said locking rods extends between one of said lower engagement apertures and a corresponding one of said upper engagement apertures.

* * * * *